US007686662B2

(12) United States Patent
Schneider

(10) Patent No.: US 7,686,662 B2
(45) Date of Patent: Mar. 30, 2010

(54) ELECTRICAL CONNECTOR ASSEMBLY

(75) Inventor: Robert Schneider, Gordsberg (DE)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 12/191,756

(22) Filed: Aug. 14, 2008

(65) Prior Publication Data

US 2009/0075530 A1 Mar. 19, 2009

(30) Foreign Application Priority Data

Sep. 18, 2007 (DE) ..... 10 2007 044 412

(51) Int. Cl.
*H01R 4/48* (2006.01)

(52) U.S. Cl. ..... 439/834

(58) Field of Classification Search ..... 439/834, 439/744, 745, 839, 847, 891
See application file for complete search history.

(56) References Cited

U.S. PATENT DOCUMENTS

| | | | | |
|---|---|---|---|---|
| 4,687,278 | A | 8/1987 | Grabbe et al. | |
| 5,240,439 | A | 8/1993 | Egenolf | |
| 5,246,390 | A | 9/1993 | Egenolf | |
| 5,338,229 | A | 8/1994 | Egenolf | |
| 5,437,567 | A | 8/1995 | Peterson | |
| 5,938,485 | A * | 8/1999 | Hotea et al. | 439/839 |
| 6,086,433 | A | 7/2000 | Hils et al. | |
| 6,524,142 | B2 | 2/2003 | Heimueller | |
| 6,547,608 | B2 * | 4/2003 | Sato et al. | 439/852 |
| 6,749,470 | B2 | 6/2004 | Dangelmaier | |
| 2001/0019921 | A1 | 9/2001 | Heimueller | |
| 2006/0035535 | A1 | 2/2006 | Kawahara et al. | |

FOREIGN PATENT DOCUMENTS

| | | |
|---|---|---|
| DE | 10331034 A1 | 3/2004 |
| WO | 8905531 A1 | 6/1989 |

* cited by examiner

*Primary Examiner*—Edwin A. Leon
(74) *Attorney, Agent, or Firm*—MacMillan, Sobanski & Todd, LLC

(57) ABSTRACT

An electrical connector assembly includes a sleeve having an upper wall, a base wall, and opposing side walls. The upper wall, the base wall, and the opposing side walls define an opening and an interior within the sleeve. The upper wall defines first and second resilient spring webs. The base wall includes a resilient bridge web having a first mating structure formed therein. A pin is configured for insertion through the opening of the sleeve and into the interior such that insertion of the pin causes flexing of the bridge web and the first and second spring webs. The pin has a second mating structure for engaging with the first mating structure of the bridge web to secure the pin relative to the sleeve. The connecting portions of the first and second spring webs form a joint which is welded to connect the connecting portions of the first and second spring webs.

16 Claims, 4 Drawing Sheets

ELECTRICAL CONNECTOR ASSEMBLY

CROSS-REFERENCE TO RELATED APPLICATIONS

This application claims priority to German Patent Application No. 10 2007 044 412.7 filed Sep. 18, 2007.

BACKGROUND OF THE INVENTION

This invention relates in general to an electrical connector. In particular, this invention relates to an improved electrical socket-type connector such as those used in high temperature applications.

Connecting two or more wires to each other typically involves the use of interengaging electrical connectors. A wide variety of interengaging electrical connectors employ a flat connector and a sleeve or socket terminal, wherein the flat connector is inserted into the socket terminal to form the electrical connection. The socket terminal is stamped in one piece from sheet metal and subjected to bending operations so as to form the pluggable socket contact. The top, bottom and/or side walls of the socket terminal can have open seams or slits that may open, or "bulge" upon insertion of the flat connector. Opening, or bulging, of the seam or slit can result in poor contact between the flat connector and the socket terminal resulting in a poor electrical connection or a connection that can vibrate loose. It is known to weld the seam together, such as that shown in U.S. Pat. No. 5,246,390.

A flat connector inserted into a socket terminal may involve a contact force which is exerted by the socket on the flat connector. The contact force retains the flat connector within the socket terminal and assists in attaining a stable electrical connection between the socket terminal and the flat connector. The socket terminal may include a contact spring, which can be either a spring integral to the stamped socket terminal or a separate spring incorporated into the socket terminal. Such an electrical connector is shown in U.S. Pat. No. 6,086,433. The spring is typically configured such that insertion of the flat connector deflects the spring, forcing the surface of the flat connector against a surface of the socket terminal. In order to obtain a stable electrical connection between the inserted flat connector and the socket terminal, it is desirable that the contact spring exert a relatively high force on the flat connector. A high spring force results in a relatively high insertion force and a relatively high force necessary to remove the flat connector from the socket terminal. Thus, it would be desirable to provide an improved flat connector and socket terminal that prevents bulging upon insertion of the flat connector and has an acceptable insertion and removal force.

SUMMARY OF THE INVENTION

This invention relates to an electrical connector assembly includes a sleeve having an upper wall, a base wall, and opposing side walls. The upper wall, the base wall, and the opposing side walls define an opening and an interior within the sleeve. The upper wall defines first and second resilient spring webs. The base wall includes a resilient bridge web having a first mating structure formed therein. A pin is configured for insertion through the opening of the sleeve and into the interior such that insertion of the pin causes flexing of the bridge web and the first and second spring webs. The pin has a second mating structure for engaging with the first mating structure of the bridge web to secure the pin relative to the sleeve. The connecting portions of the first and second spring webs form a joint which is welded to connect the connecting portions of the first and second spring webs.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
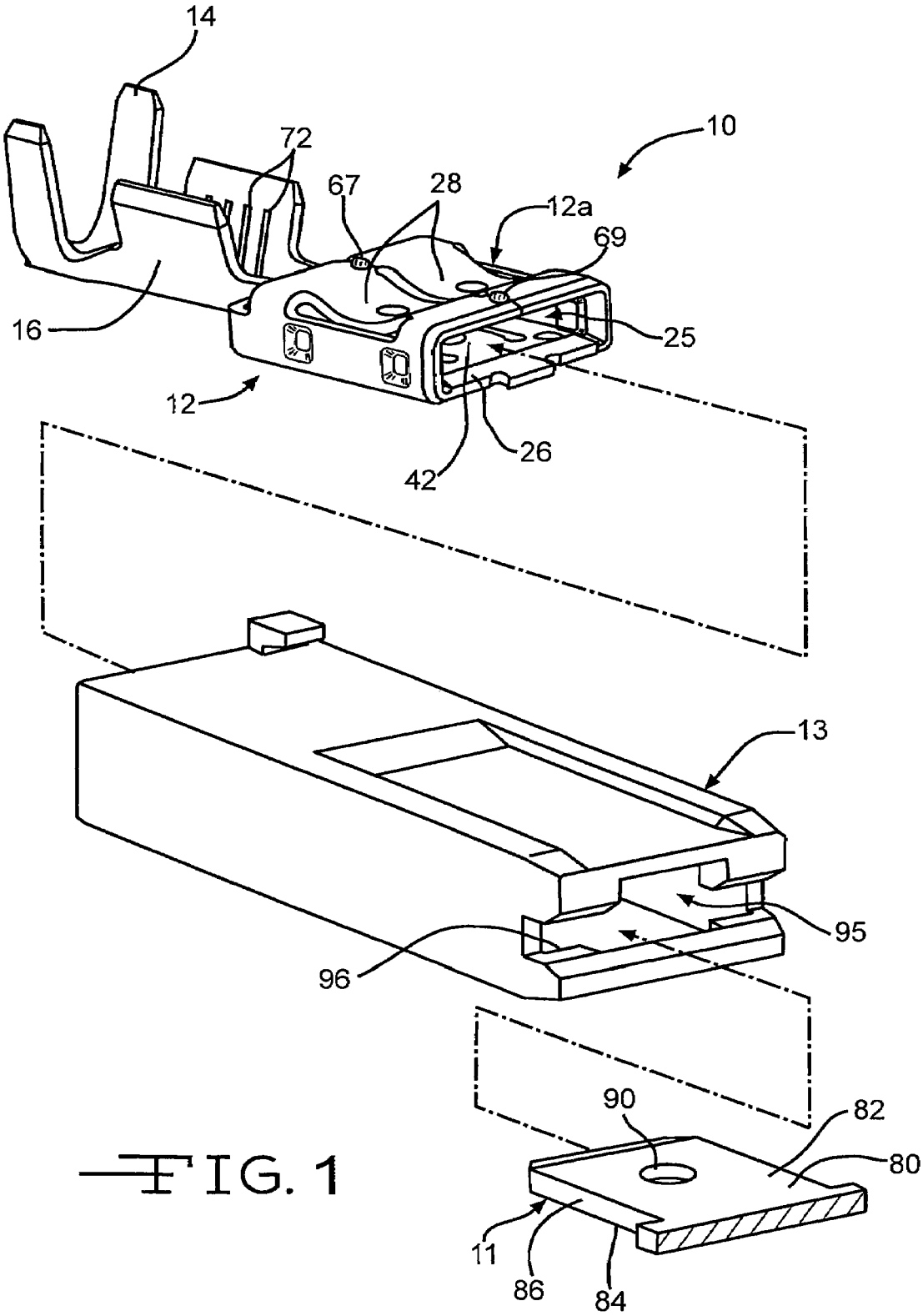
FIG. 1 is an exploded perspective view of an electrical connector assembly.
Figure 2:
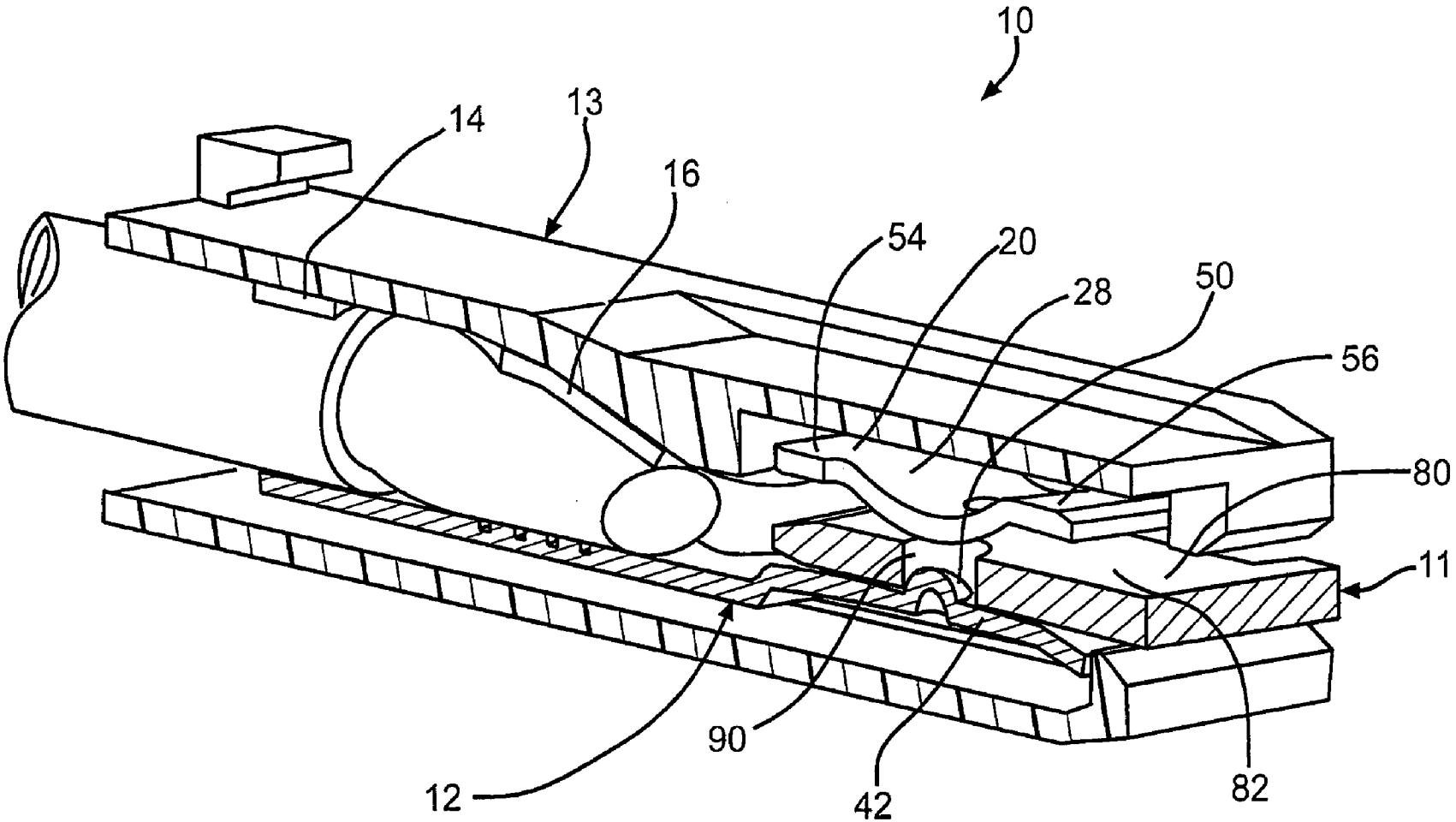
FIG. 2 is a perspective view, partially broken away, of the combined assembly of FIG. 1.
Figure 3:
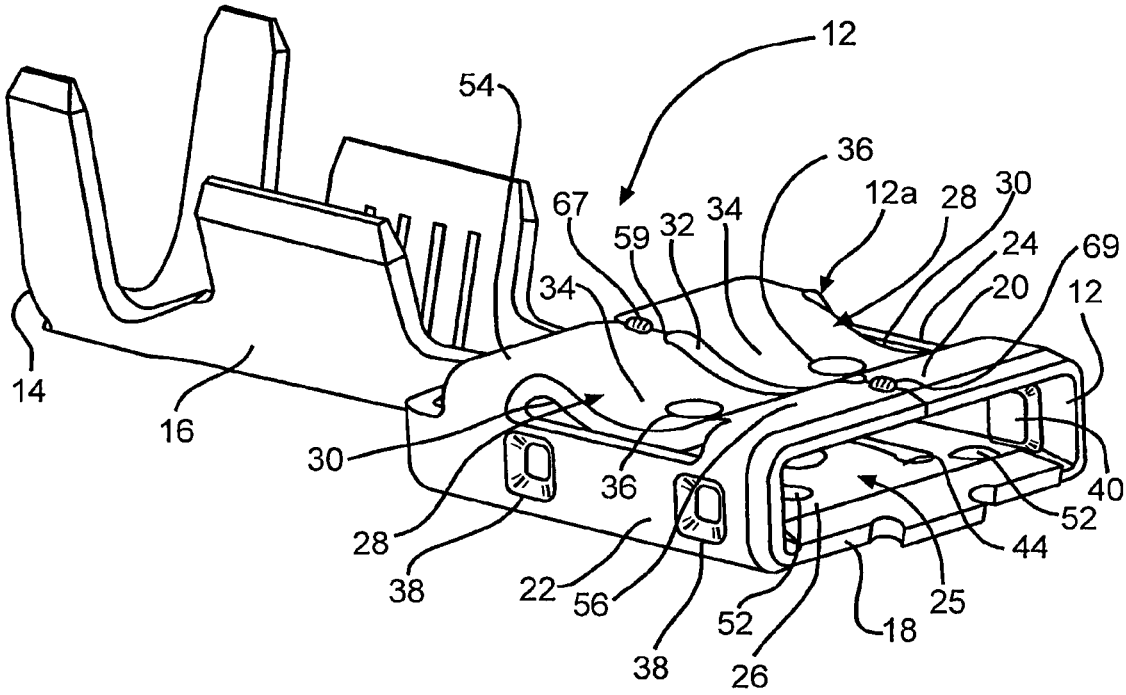
FIG. 3 is a perspective view of a sleeve of the assembly of FIG. 1.
Figure 4:
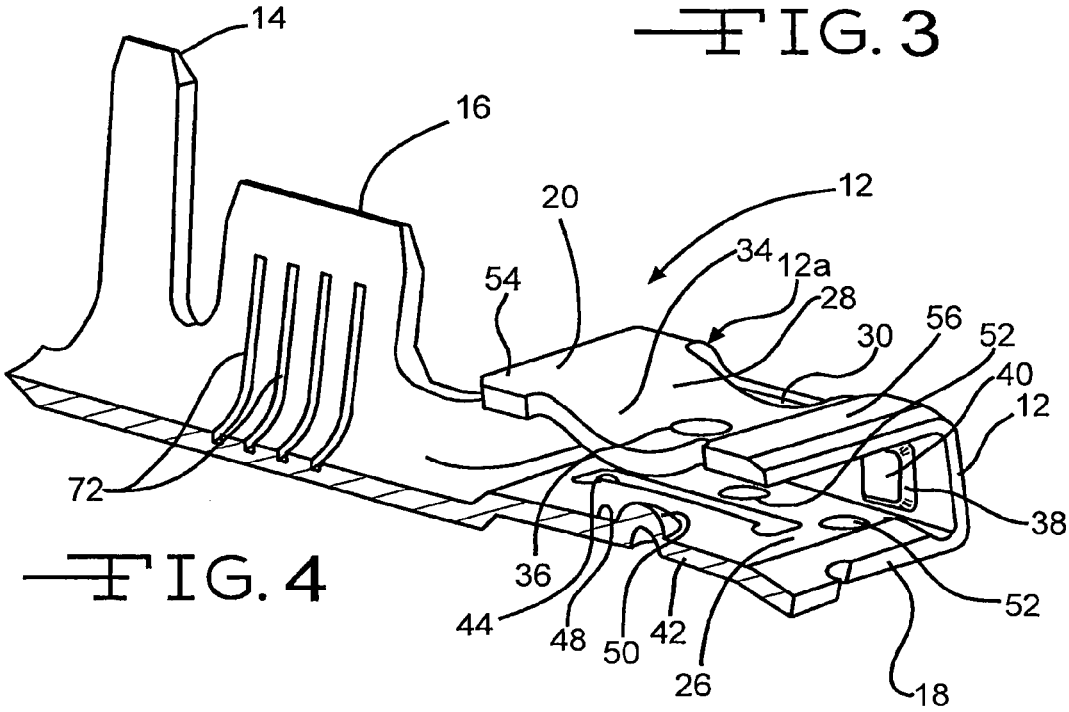
FIG. 4 is a cross-sectional view of the sleeve generally taken along lines 4-4 in FIG. 3.

Referring now to the drawings, there is illustrated in FIGS. 1 and 2, an electrical connector assembly, indicated generally at 10. The assembly 10 generally includes a connector pin 11, a sleeve 12, and a covering or housing 13. Note that only a relatively flat connecting portion 80 of the pin 11 is shown and described in the drawings. The pin 11 and the sleeve 12 are adapted to be separately connected to a wire harness or electrical wiring. When the pin 11 and the sleeve 12 are connected, as shown in FIG. 2, the assembly 10 provides stable electrical communication between the separate electrical wiring connected to the pin 11 and the sleeve 12.

The sleeve 12 includes a box-like receptacle portion 12*a*, a pair of rear crimp arms 14, and a pair of front crimp arms 16. In one embodiment, the sleeve 12 is formed from a single flat metal blank (see FIG. 6) which is stamped or otherwise formed to form the shape of the sleeve 12 as shown in FIGS. 1 through 5. The receptacle portion 12*a* generally includes a bottom or base wall 18, an upper wall 20, a first side wall 22, and a second side wall 24. The walls 18, 20, 22, and 24 define an interior 25 and an opening 26 adapted to receive the pin 11. In the illustrated embodiment, the upper wall 20 of the receptacle portion 12*a* defines a pair of generally parallel spring webs 28 which extend toward the interior 25. The spring webs 28 define elastic or resilient portions which can flex or deform during insertion of the pin 11 into the interior 25 of the sleeve 12. Thus, the spring webs 28 function as spring members creating a spring force against the pin 11. The parallel spring webs 28 extend substantially along the length of the receptacle portion 12. It should be understood that the sleeve 12 may include any quantity of spring webs.

As further shown in FIGS. 1 and 2, edges of the spring webs 28 are defined as portions of the upper wall 20 that are located between outer slots 30 and a central slot 32 formed through the upper wall 20. The slots 30 and 32 are generally elongate and are generally parallel with one another. The spring webs 28. Each of the spring webs 28 includes a curved portion 34 which curves inwardly toward the interior 25 and the base wall 18. Optionally, the spring webs 28 may include a projection or contact cap 36 configured to provide an electrical contact point with the pin 11. In this embodiment, the contact cap 36 is a round semi-spherical dome-shaped projection.

However, the contact cap 36 may have any other desired shape or combination of shapes sufficient to provide a contact point or surface with the pin 11. Additionally, while each of the spring webs 28 illustrates a single contact cap 36, each spring web 28 may have any quantity of contact caps 36 sufficient to provide contact surface(s) with the pin 11.

As previously discussed and as shown in FIGS. 1 and 2, the receptacle portion 12 includes side walls 22 and 24. Each side wall, 22 and 24, may include one or more projections or connector guides 38 which extend towards the interior 25. Each connector guide 38 has a contact surface 40 configured to guide and contact the pin 11 through the opening 26 and into the interior 25 of the receptacle portion 12*a* of the sleeve 12. In the illustrated embodiment, the contact surface 40 is a square-shaped surface. In another embodiment, the contact surface 40 may have any other shape or combination of shapes sufficient to guide the pin 11 as the pin 11 enters the opening 26 of the receptacle portion 12*a*.

The base wall 18 defines a bridge web 42. The bridge web 42 is similar in structure and function as the spring webs 28. The bridge web 42 is defined by the portion of the base wall 18 which is disposed between slots 44 formed through the base wall 18. The slots 44 are generally elongate and are generally parallel with one another. The bridge web 42 includes a curved portion 48 which curves slightly upwardly toward the interior 25 and the upper wall 20. The curved portion 48 may include a projection 50 having a semi-spherical or dome like shape. It should also be understood that while the sleeve 12 shows a single bridge web 42, any suitable number of bridge webs may be used.

As shown in FIGS. 1 and 2, the base wall 18 further includes a plurality of projections or contact caps 52 disposed on either side of the bridge web 42. The contact caps 52 are similar in function and structure as the caps 36 described above.

As suggested above, the sleeve 12 may be formed from a single stamped blank. In the embodiment shown, the upper wall 20 is formed by joining the side edges of a blank together such that a seam 59 extends centrally through the upper wall 20. The seam 59 extends through the central slot 32. Thus, the slot 32 may be formed by joining two recessed portions of edges of a blank together. Each of the spring webs 28 define a central rear portion 54 and a central front portion 56 which abut one another at the seam 59. The abutment of the rear portions 54 forms a first joint 67 which is preferably welded together, thereby connecting the rear portions 54 of the spring webs 28 together. The abutment of the front portions 56 forms a second joint 69 which is preferably welded together, thereby connecting the rear portions 56 of the spring webs 28 together. More preferably, the joints 67 and 69 are laser welding. The welded joints 67 and 69 helps prevents the spring webs 28 from separating from each other causing the upper wall 20 to bulge outwardly upon insertion of the pin 11 in the interior 25.

The sleeve 12 is configured to attach to electrical wires 15, as shown in FIG. 2. This may be accomplished by placing the wires (not shown) between rear crimp arms 14 and the front crimp arms 16 and forming the arms 14 and 16 into a tubular shape capturing the wires, as is conventionally known. More specifically, the rear crimp arms 14 crimp onto the outer insulation of an electrical wire 15 and the front crimp arms 16 may crimp onto a stripped or exposed end portion of the conductive core of the wire 15. In this embodiment, the front crimp arms 16 include a plurality of grooves 72. The grooves 72 grip the stripped or exposed end portion of the conductive core of the wire as the wire is crimped within the front crimp arms 16. In another embodiment, the forward crimp arms 16 may include another structure, such as serrated ridges, configured to grip the stripped or exposed conductive core of the wire.

Although the pin 11 can have any suitable shape, the pin 11 is shown having a connecting portion 80 which has a relatively flat planar shape. The connecting portion 80 includes an upper surface 82, a lower surface 84, and side surfaces 86. An aperture 90 is formed through the pin 11. In a preferred embodiment, the sleeve 12 and the pin 11 are made of electrically conductive material, such as metal such that direct contact between portions of the sleeve 12 and the pin 11 will provide electrical communication therebetween. It is noted that only the connecting portion of the pin 11 is shown, and it should be understood that the pin 112 may include suitable structures, such as those similar to the crimp arms 14 and 16, for connecting to a wire harness or electrical wiring.

The assembly 10 may further include the housing 13 which may be made of an insulating material. The material may be electrical non-conductive as well as heat resistant. The housing 13 includes a hollow interior 95 and openings 96 for receiving the sleeve 12 and the pin 11. The housing 13 can have any suitable shape for covering the connected sleeve 12 and pin 11. The assembly 10 is ideally suited for electrical connection in heated environments such as industrial ovens due to the nature of the engagement between the sleeve 12 and the pin 11 due to the plurality of contact points provided and the spring biased rigidness of their engagement.

To connect the pin 11 to the sleeve 12, the connecting portion 80 of the pin 11 is inserted through the opening 26 of the receptacle portion 12*a* of the sleeve 12. During movement of the pin 11 into the interior 25, the spring webs 28 and the bridge web 42 will engage with and contact the pin 11. More specifically, the upper surface 82 of the pin 11 will contact the contact caps 36 of the spring webs 28. The lower surface 84 of the pin 11 will contact the contact caps 52 of the bridge web 42 and the projection 50. The side surfaces 86 of the pin 11 may also contact the contact surfaces 40 of the connector guides 38 of the side walls 22 and 24 of the sleeve 12, although such contact is not necessary. Upon further insertion of the pin 11, the spring webs 28 and the bridge web 42 may deform or flex in a direction outwardly relative to the interior 25 to accommodate the dimensions of the pin 11 as the pin 11 slides over the projection 50. The vertical distance between the contact caps 36 and 50 is preferably slightly less than the height of the connecting portion 80 of the pin 11. The pin 11 is further inserted into the interior 25 until the projection 50 extends upward through the aperture 90 of the pin 11, thereby providing a snap fit locking arrangement between the sleeve 12 and the pin 11, as shown in FIG. 2. It should be understood that any suitable mating structures may be used in place of the aperture 90 and the projection 50 which provide a snap fit resilient engagement. Alternatively, the aperture 90 may be formed on the bridge web 42 and the projection may be formed on the pin 11.

The spring forces of the resilient spring webs 28 and the bridge web 42 acting against the pin 11 retains the pin 11 within the sleeve 12. By providing multiple resilient webs 28 and 42, the spring force required to completely insert the pin 11 into the sleeve 12 is less than the force required for conventional electrical connectors having fewer resilient arm members. Once connected, the housing 13 can then be disposed over the sleeve 12. For removal, the pin 11 is simply pulled out of the sleeve 12 with sufficient force to overcome the spring forces of the spring webs 28 and the bridge web 42.

Figure 5:
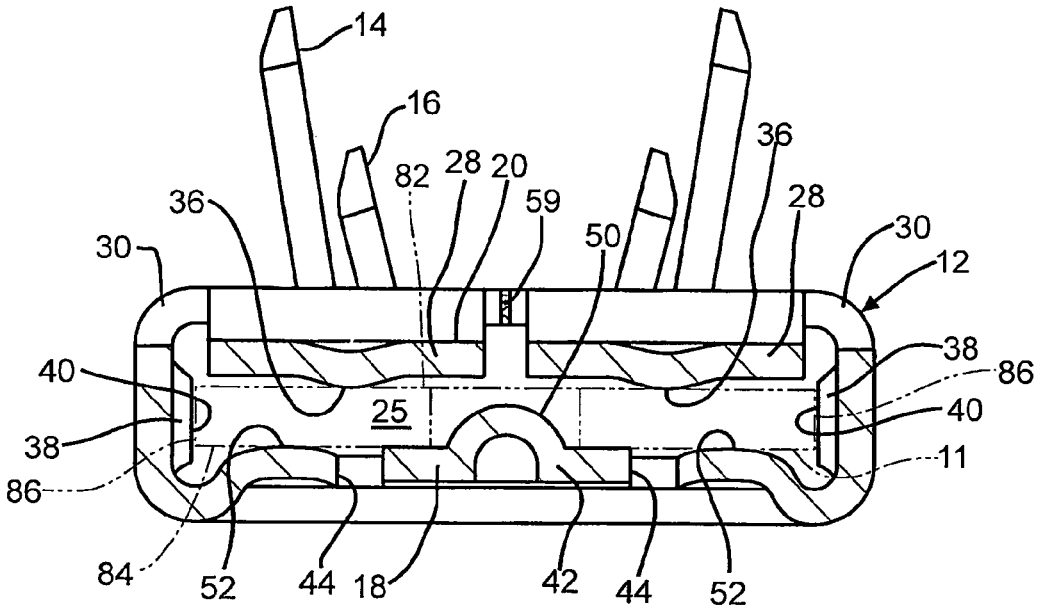
FIG. 5 is a cross-sectional view of the sleeve generally taken along lines 5-5 in FIG. 3, wherein a cross-sectional view of the pin is shown in broken lines.
Figure 6:
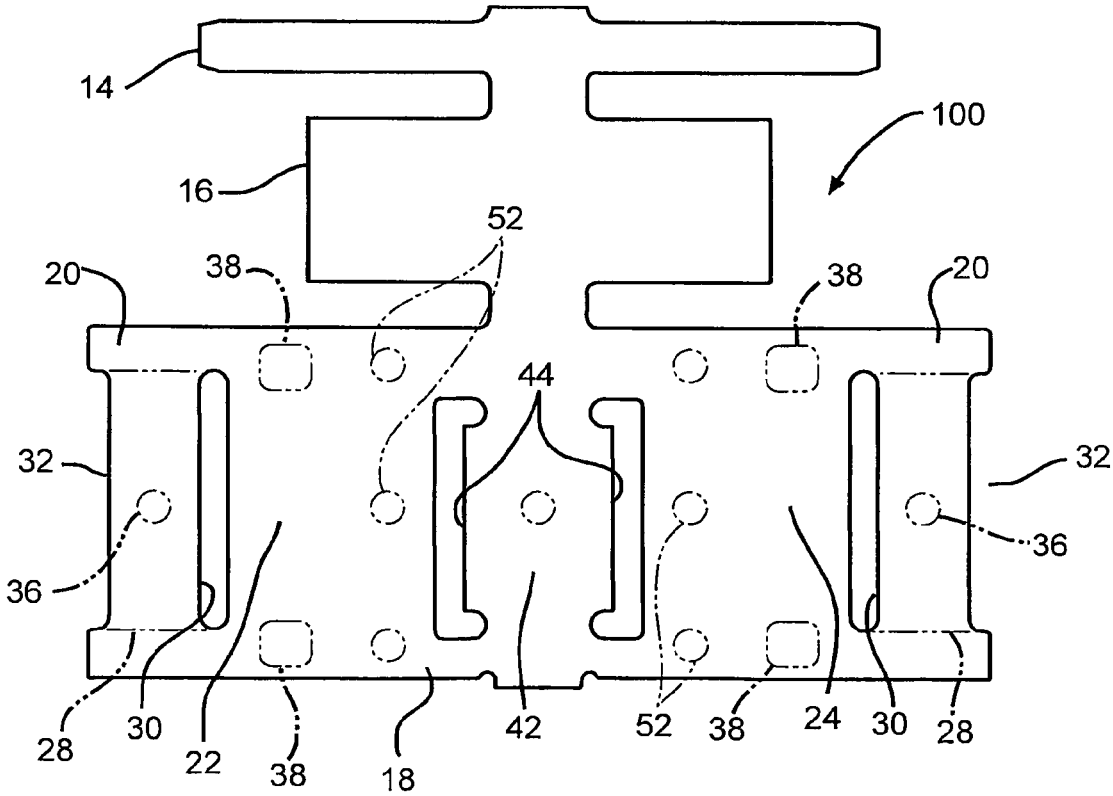
FIG. 6 is a plan view of a blank which may be used to form the sleeve of FIG. 3.

There is illustrated in FIG. 5 an example of a generally planar blank 100 that may be used to form the sleeve 12. Reference numbers corresponding to the various structures of the sleeve 12 described above are included corresponding to portions of the blank 100 that define such structures.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. An electrical connector assembly comprising:

a sleeve including an upper wall, a base wall, and opposing side walls, said upper wall, base wall, and opposing side walls defining an opening and an interior, said upper wall defining first and second resilient spring webs, said base wall including a resilient bridge web having a first mating structure formed therein; and a pin configured for insertion through said opening and into said interior such that insertion of said pin causes flexing of said bridge web and said first and second spring webs, said pin having a second mating structure for engaging with said first mating structure of said bridge web to secure said pin relative to said sleeve;

wherein connecting portions of said first and second spring webs are adjacent one another to form a joint, and wherein said joint is welded to connect said connecting portions of said first and second spring webs.

2. The assembly of claim 1, wherein said joint is formed by laser welding.

3. The assembly of claim 1, wherein said sleeve is formed from a single stamped sheet of material.

4. The assembly of claim 3, wherein said sleeve and said pin are formed from metal.

5. The assembly of claim 1, wherein said first mating structure is an outwardly extending projection, and wherein said second mating structure is an aperture.

6. The assembly of claim 5, wherein said projection is semi-spherical in shape.

7. The assembly of claim 6, wherein said aperture of said pin is circular.

8. The assembly of claim 1 further including an insulator for covering said sleeve and said pin.

9. The assembly of claim 1, wherein each of said first and second spring webs has first and second connecting portions, and wherein said first connecting portions are welded together, and wherein said second connecting portions are welded together.

10. The assembly of claim 1, wherein said sleeve further includes a pair of crimp arms for receiving and retaining an electrical wire.

11. The assembly of claim 1, wherein said bridge web is formed by providing a pair of spaced apart slots in said base wall such that a portion of said base wall between said spaced apart slots defines said bridge web.

12. The assembly of claim 1, wherein said base wall includes contact projections extending towards said interior and directly engaged with said pin to provide electrical contact therebetween.

13. The assembly of claim 1, wherein said side walls include contact projections extending towards said interior and directly engaged with said pin to provide electrical contact therebetween.

14. The assembly of claim 1, wherein said portion of said pin which is inserted within the interior of said sleeve is generally planar in shape.

15. An electrical connector assembly comprising:

a sleeve including an upper wall, a base wall, and opposing side walls, said upper wall, base wall, and opposing side walls defining an opening and an interior, said upper wall defining first and second resilient spring webs, said base wall including a resilient bridge web having a first mating structure formed therein, connecting portions of said first and second spring webs being disposed adjacent one another and secured together to form a joint; and a pin configured for insertion through said opening and into said interior such that insertion of said pin causes flexing of said bridge web and said first and second spring webs, said pin having a second mating structure for engaging with said first mating structure of said bridge web to secure said pin relative to said sleeve.

16. An electrical connector assembly comprising:

a sleeve formed from a unitary piece of material and including an upper wall, a base wall, and opposing side walls, said upper wall, base wall, and opposing side walls defining an opening and an interior, said upper wall defining first and second resilient spring webs, said base wall including a resilient bridge web having a first mating structure formed therein, connecting portions of said first and second spring webs being disposed adjacent one another and secured together to form a joint; and a pin configured for insertion through said opening and into said interior such that insertion of said pin causes flexing of said bridge web and said first and second spring webs, said pin having a second mating structure for engaging with said first mating structure of said bridge web to secure said pin relative to said sleeve.

* * * * *